United States Patent [19]

Kornhauser

[11] Patent Number: 4,833,967

[45] Date of Patent: May 30, 1989

[54] EXPLOSION PREVENTING IMPACT SHIELD

[76] Inventor: Murray Kornhauser, 620 Argyle Rd., Wynnewood, Pa. 19096

[21] Appl. No.: 120,977

[22] Filed: Nov. 16, 1987

[51] Int. Cl.[4] ..... F42B 37/00

[52] U.S. Cl. ..... 89/34; 89/36.02; 206/3

[58] Field of Search ..... 89/34, 36.17, 36.02; 102/493; 206/3

[56] References Cited

U.S. PATENT DOCUMENTS

| | | | |
|---|---|---|---|
| 174,771 | 3/1876 | Broadwell | 102/493 |
| 848,024 | 3/1907 | Gathmann | 89/36.02 |
| 3,153,500 | 10/1964 | Pachmayr et al. | 206/3 |
| 3,491,694 | 1/1970 | Fountain | 102/493 |
| 3,636,895 | 1/1972 | Kelsey | 89/36.02 |
| 4,248,342 | 2/1981 | King et al. | 206/3 |
| 4,305,333 | 12/1981 | Altenaii et al. | 102/493 |
| 4,312,274 | 1/1982 | Zernow | 102/493 |
| 4,768,418 | 9/1988 | Blommer et al. | 89/34 |

FOREIGN PATENT DOCUMENTS

| | | | |
|---|---|---|---|
| 70689 | 6/1959 | France | 89/36.02 |

OTHER PUBLICATIONS

Preprint UCRL-70891 Rev. 1 for F. E. Walker and R. J. Wasley, "Critical Energy for Shock Initiation of Heterogeneous Explosives", *Explosivstoffe 17* (1), 9 (1969).

Hans Spies, "Casing for the Protection of Explosive Charges", 9864 U.S., Ser. No. 19,169.

*Primary Examiner*—Deborah L. Kyle
*Assistant Examiner*—Richard W. Wendtland
*Attorney, Agent, or Firm*—Woodcock Washburn Kurtz Mackiewicz & Norris

[57] ABSTRACT

A shield adapted for preventing impact from causing an energetic reaction of a munition containing explosive which comprises a cylindrical shell emplaced around the munition and includes means for reducing the shock wave energy transmitted to the explosive, said means consisting of hardened protuberances located between the shield's shell and the casing of the munition. The protuberances may have the shape of a cone or a pyramid or a wedge, with the sharp point or edge in contact with the casing of the munition.

14 Claims, 3 Drawing Sheets

EXPLOSION PREVENTING IMPACT SHIELD

BACKGROUND OF THE INVENTION

This invention relates to a shield that can be emplaced around a bomb or other munition-containing explosive for purposes of preventing an explosive reaction in the event a bullet or fragment or other high velocity body impacts the shield.

A variety of armor systems have been developed for shielding bombs and other munitions from being impacted by high velocity bodies, thereby preventing a detonation or other explosive reaction by virtue of stopping the body from reaching the surface of the munition. The methods and apparatus employed in these armor systems are various. Some armor systems use a single layer of reinforced material. See, e.g., U.S. Pat. No. 848,024 to Gathmann. Others use multiple layers of one or more materials. See, e.g., U.S. Pat. No. 4,664,967 to Tassdemiroglu. Still others use tilted layers of one or more materials. See, e.g., U.S. Pat. No. 3,636,895 to Kelsey. In all the above instances cited, the primary objectives of these variations in the design features of the armor system are to minimize weight of and/or space required for the armor system, while still preventing impact on the surface of the munition being protected.

With the same objective of minimizing weight penalties, shields have been developed that do permit impacts on the surface of the munition, but these shield limit the impact conditions in order to prevent an explosive reaction. One shield of this type, called the diverter, prevents reactions by diverting fragments in order that they impact the munition at grazing angles of obliquity. Other impact-permitting shields employ soft buffer materials that do not generate high enough impact pressures to cause explosive reactions. This invention is an impact-permitting shield that employs mechanisms that limit the duration of pressure transmitted to the explosive, to the extent that not enough energy is delivered to the explosive to cause an energetic reaction. The shield consists of a cylindrical shell emplaced around the munition, and the basic duration-limiting mechanism is a pointed or wedge-shaped protuberance between the interior surface of the shield's shell and the surface of the munition, with the sharp contact touching the munition. Explanation of the physics of how the sharp contact reduces the duration of shock wave loading during an impact will be made later.

SUMMARY OF THE INVENTION

In accordance with the present invention, a shield for preventing impacting from causing an energetic reaction of a munition containing explosives includes a cylindrical shell emplaced around the munition and having means for reducing the shock wave energy transmitted to the explosive. Hardened interior protuberances are located between the shell and the casing to reduce the shock wave energy transmitted to the explosives. These interior protuberances have the shape of a cone or pyramid with the sharp point of the cone or pyramid in contact with the casing of the munition.

In accordance with another embodiment of the invention, the shield also has hardened exterior protuberances which are located in areas of the shell that do not have interior protuberances. The exterior protuberances are shaped in such a manner that they deflect impacting bullets and fragments toward areas of the shield shell which contain interior protuberances.

BRIEF DESCRIPTION OF THE DRAWINGS

This invention provides novel methods of preventing explosive reactions when a high velocity body impacts a munition containing explosives.

FIG. 2 shows a diametral cross-section view of the munition and the shield constructed in accordance with this invention wherein the interior and the exterior protuberances are attached to a light weight cylindrical shell;

DESCRIPTION OF THE PREFERRED EMBODIMENT

Figure 1:
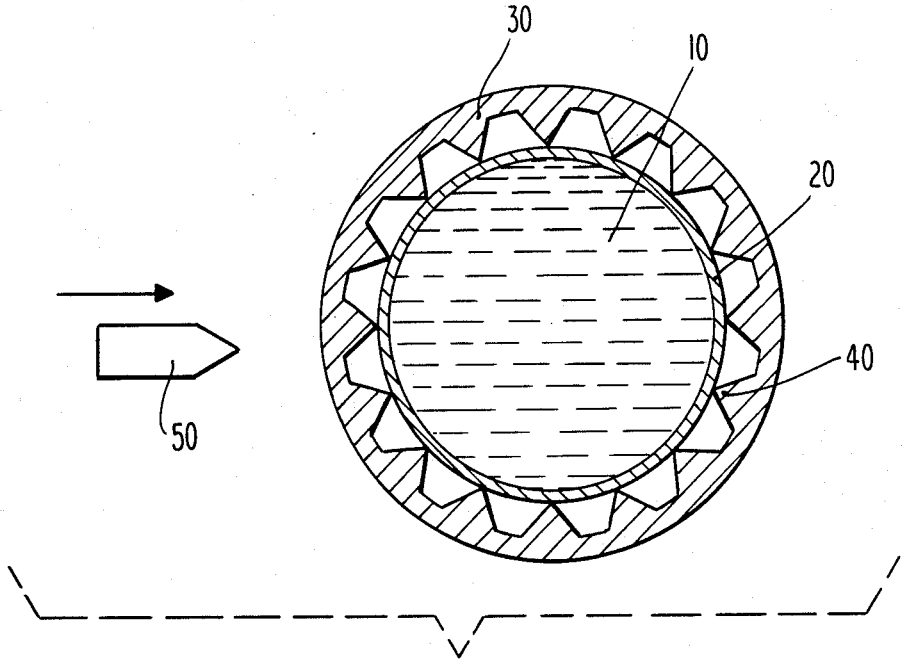
FIG. 1 shows a diametral cross-section view of the munition and the shield constructed in accordance with this invention wherein the exterior of the shield has a smooth surface without protuberances.
Figure 2:
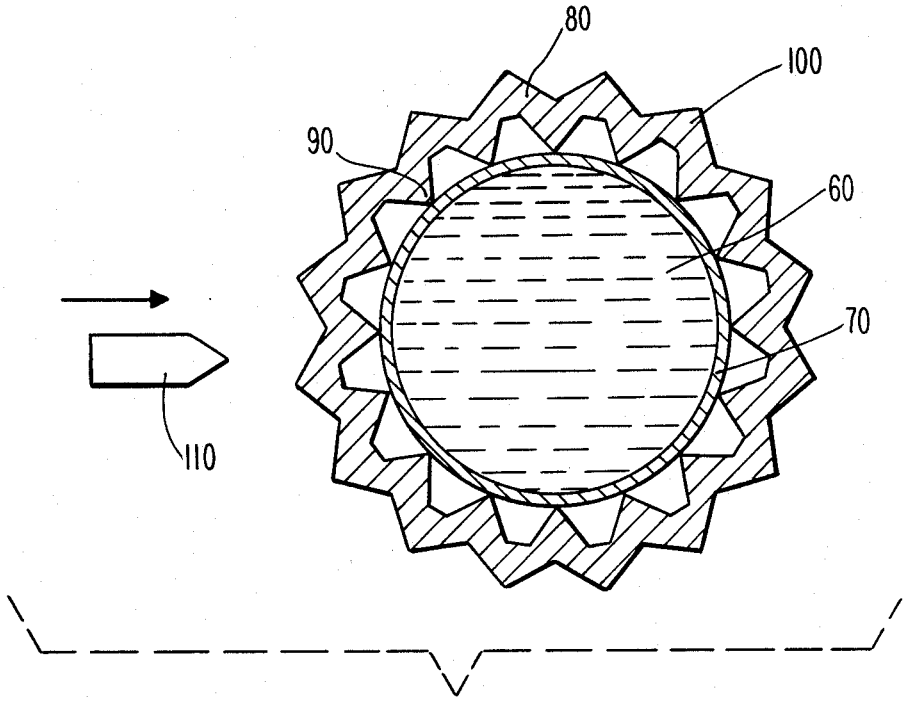
FIG. 2 shows a diametral cross-section view of the munition and the shield constructed in accordance with this invention wherein the exterior of the shield contains pointed protuberances.
Figure 3:
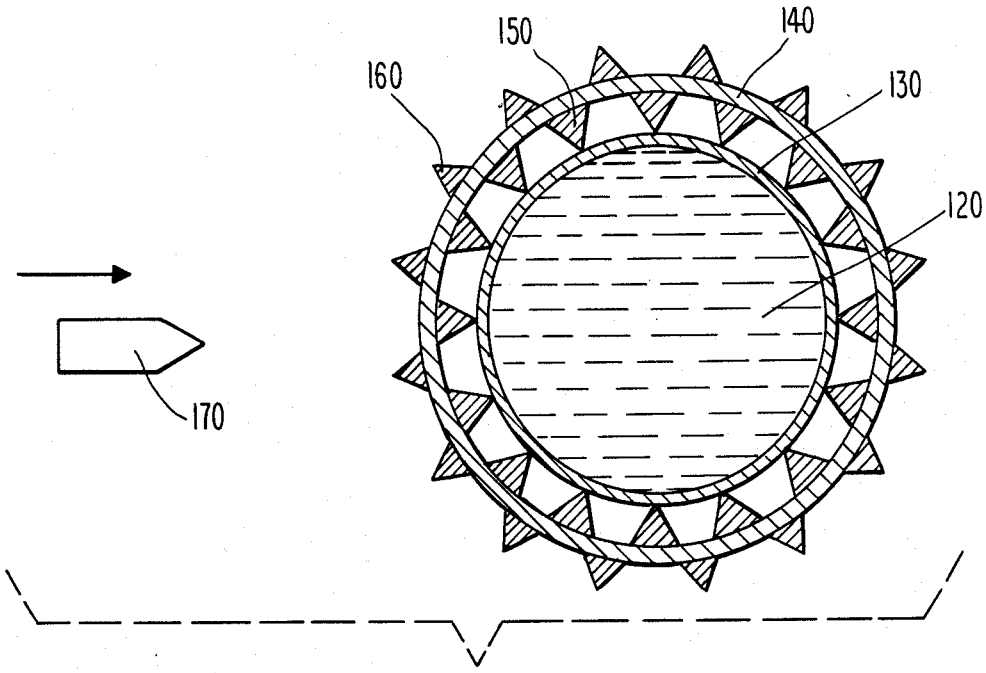

FIGS. 1, 2 and 3 show diametral cross-sections of shields made in accordance with this invention. Inside the shields are munitions, to be protected from initiation of explosion by bullets approaching the shields at high velocities. In these embodiments of the invention, the shield's internal protuberances are aligned longitudinally, parallel to the munition's axis.

FIG. 1 shows the munition's casing 20 surrounding the explosive 10. The shield consists of cylindrical shell 30 with integral internal longitudinal protuberances 40 which may consist of pointed cones or short wedges or continuous wedges running the full length of the shield. When bullet or fragment 50 impacts the shield shell 30 the protuberances 40 strike the munition's casing 20. Shock waves are generated in casing 20 and transmitted through the casing to the explosive 10. In accordance with the theory of the invention, to be explained further, the duration of shock wave loading is limited because the sharp points or edges of the shield's internal protuberances introduce rarefaction waves, and thereby the shock wave energy transmitted to the explosive is prevented from exceeding the threshold energy required for initiation of explosive reaction. Internal protuberances 40 are made of hardened steel or other material harder than casing 20 in order to prevent deformation of the sharp points or edges. Internal protuberances 40 penetrate through casing 20 thereby creating vents that prevent hydrodynamic pressure buildup as the cylindrical shell of the shield 30 strikes casing 20 and begins to crush the munition. The munition may be damaged by the impact but the object of the invention is achieved if its explosive does not react energetically.

FIGS. 2 shows the shield made in accordance with this invention wherein the shield shell 80 contains exterior protuberances 100. Exterior protuberances 100 are designed to reduce shielding weight required to prevent bullet 110 from penetrating through shield body 80 in areas between interior protuberances 90. This function is achieved by making exterior protuberances 100 of a hard material with a shape that deflects bullet 110 toward the locations of interior protuberances 90. As in FIG. 1, interior protuberances 90 are made of a hard material.

FIG. 3 shows an alternate embodiment of the sharp shield within shield shell 140 is made of a low density material to which the hard, higher density, protuberances 150 and 160 are affixed. The purpose of this embodiment is to reduce the overall weight of the shielding system.

Figure 4:
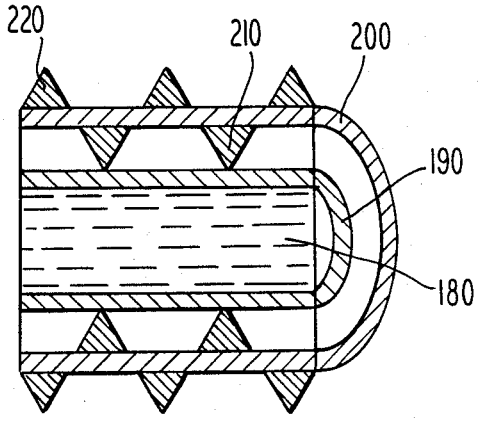
FIG. 4 shows a longitudinal cross-section view of the munition and the shield constructed in accordance with this invention wherein the protuberances consist of wedges or rings running in the circumferential direction.
Figure 5A:
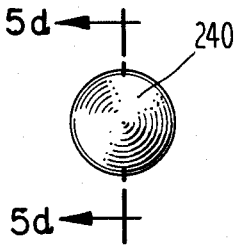
Figure 5B:
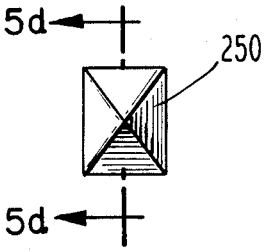
Figure 5C:
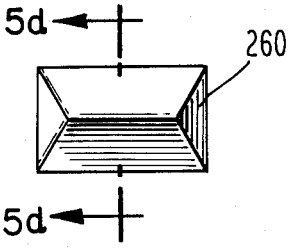

FIG. 4 shows a longitudinal cross-section view of the munition casing 190 and explosive 180 and the shield shell 200 with interior protuberances 210 and exterior protuberances 220, wherein the protuberances consist of wedges or rings running in the circumferential direction. The purpose of the circumferential embodiment is to reduce the deflection of casing 190 while interior protuberances 210 penetrate casing 190. It may be shown theoretically and experimentally that circumferential points or wedges develop higher casing stresses per unit deflection than longitudinal points or wedges, thus promoting casing rupture with less casing deflection. It may also be shown that dynamic casing deflections introduce inertial pressures in the explosive that promote explosive reactions. Therefore, minimizing deflections of casing 190 before penetration of protuberances 210 tends to lower the probability that explosive 180 will react energetically.

Figure 5D:
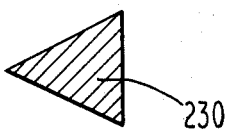
FIGS. 5*a–d* shows some shapes of the protuberances.

FIGS. 5*a–d* shows some embodiments of protuberances that may run longitudinally, as in FIGS. 1, 2 and 3 or circumferentially as in FIG. 4. FIG. 5(*a*) shows a protuberance 240 in the shape of a right circular cone. FIG. 5(*b*) shows a protuberance 250 with the shape of a regular pyramid. FIG. 5(*c*) shows a protuberance 260 in the shape of a wedge. FIG. 5*d* shows a cross-section 230 taken along the 5*d* lines of the protuberances shown in FIGS. 5*a*, 5*b*, and 5*c*. If a protuberance is applied longitudinally its length may be the same as the length of the shell of the shield or there may be several shorter wedges in line to equal the length of the shield's shell. If protuberance 260 is applied circumferentially it may be in the form of a complete ring, or several protuberances may abut each other to comprise a complete 360° ring.

Figure 6:
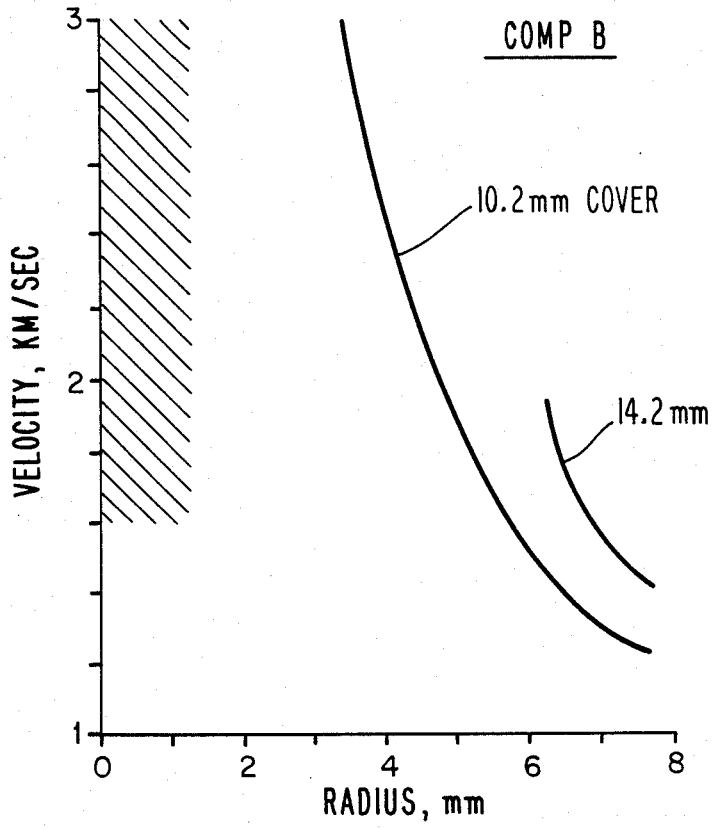
FIGS. 6 and 7 contain plots of experimental data on initiation of explosive reactions obtained by impacts of flat-nose bullets against covered explosives.
Figure 7:
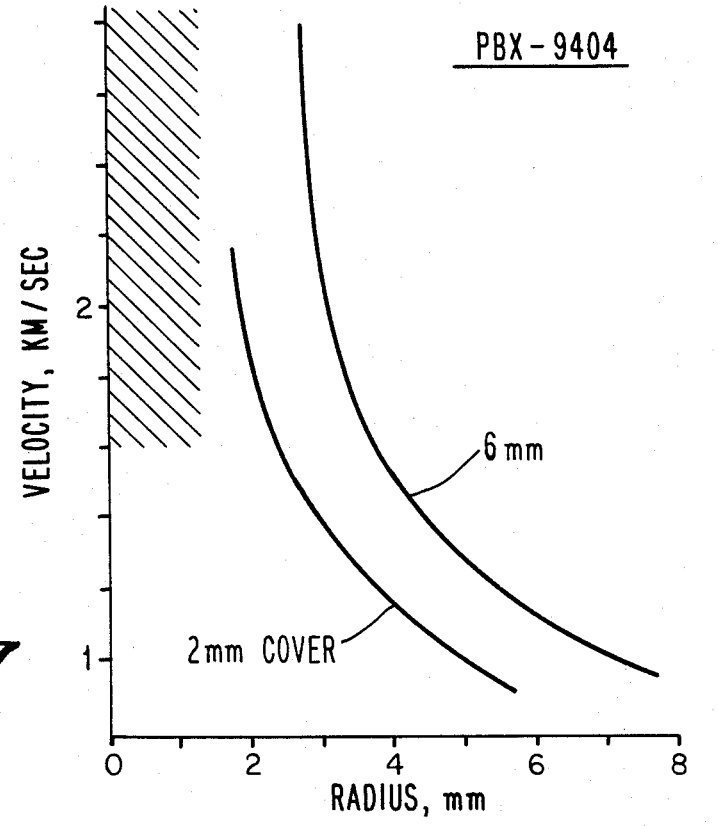

FIGS. 6 and 7 are described in the following discussion of the theory of the invention.

THEORY OF THE INVENTION

In order to undersand what combination of impact conditions are required to produce explosive reactions, the roles of impact velocity, pressure, and duration of pressure must be elucidated. It has long been known that impacts produce pressure waves and that the amplitude of pressure in a wave depends on the impact velocity and the impedances of the impacting material and the impacted material, where impedance of a material is equal to material density times wave front transmission speed in the material. For any given impact velocity, the higher the impedances the higher the pressure in the wave. It has also been known that pressure amplitude and the duration of pressure both enter into the equation defining the threshold for explosive reaction. The longer the duration of pressure the less the amplitude of pressure required for reaction. It was only recently, however, that Walker and Wasley (Ref: Walker, F. E. and R. J. Wasley "Critical Energy for Shock Initiation of Heterogeneous Explosives" Explosivstoffe 17, 1969, pp. 9–13) discovered the functional relationship of pressure amplitude and duration that defines the impact conditions required for initiation of reaction of any particular explosive. For short duration inputs to the explosive, with impact durations of the order of 100 microseconds or less, there is a critical amount of energy, Ec, required to cause an explosive reaction. Ec is a threshold characteristic of the explosive, as shown in the following Table for some explosives:

TABLE

| Explosive | E, CAL/CM$^2$ |
|---|---|
| Tetryl | 10 |
| PBX-9404 | 15 |
| TNT(CAST) | 32 |
| COMP B | 35 |

Walker and Wasley discovered that the following relationship holds:

$$P^2t/\rho_o U = Ec \qquad \text{Equation (1)}$$

where P is the pressure, t is the duration of pressure, U is the velocity of a pressure wave in the explosive (somewhat higher than the speed of sound in the explosive, depending on pressure), and $\rho_o$ is density of the explosive at atmospheric pressure. Although U does vary somewhat with pressure it is relatively constant, and therefore, the product $\rho$hd o UEc is approximately a constant of an explosive. According to Equation (1), if $\rho_o$ UEc is a constant, then $P^2{}_t$ is also a constant of the explosive in question. Stated otherwise, if $P^2t$ delivered to an explosive during an impact exceeds the threshold value of Ec times $\rho_o$U of the explosive, this will result in an energetic reaction. Also, if the $P^2t$ can be reduced below $\rho_o$ UEc by the impact-permitting shield, the shield will be successful in preventing the energetic reaction.

As stated previously, this invention reduces $P^2t$ below $\rho_o$ UEc by reducing loading duration, t. The duration of pressure loading at any point in the munition is the time difference between when the pressure wave reaches that point and when a rarefaction wave reaches that same point, at which time the rarefaction wave cancels the pressure wave and the loading period is ended.

Rarefaction waves are generated when pressure waves reflect from free surfaces of the impacting body and the impacted body. In the simplest geometry of impact when a flat flyer plate is hurled against a flat explosive target for purposes of measuring Ec, the earliest rarefaction wave arrives at time 2h/U, where h is the thickness of the flyer plate. Another simple geometry exists when a flat-nose bullet with radius, R, strikes the explosive. In this case (if R is less than twice the length of the bullet) the earliest rarefaction wave arrives at the intersection of the bullet-explosive interface and the axis of the bullet at time R/U after impact. The method of limiting pressure loading duration employed in this invention is to limit R of the portion of the shield that strikes the munition. Since duration is equal to R/U, any reduction of R results in a reduction in loading time R/U.

Explosive initiation tests have been conducted with hardened flat-nose bullets impacting on bare explosives and on explosives covered with metal. A test series is run for each explosive, each cover material and each cover thickness in order to determine the minimum impact velocity or threshold for initiation of an energetic reaction. Each threshold impact velocity (and consequently, the threshold impact pressure) is found for each bullet diameter by varying the velocity and recording reactions and non-reactions. FIG. 6 contains plots of threshold impact velocity vs. bullet diameter for covers of various thickness over COMP B. FIG. 7 contains similar plots for PBX-9404. These sets of data are highly significant for two reasons, as follows:

(1) When an adequate physical model of the geometry of the right circular cylinder impacting on a plate covering the explosive is applied to the data of FIGS. 6 and 7, it is found that the theory expressed by Equation (1) is confirmed. In other words, when the threshold velocity data are converted to pressure and when the loading duration is determined by arrival times of pressure waves and rarefaction waves at the explosive, the calculated values of $P^2t/\rho_oU$ are relatively constant and in agreement with Ec values determined by other laboratory tests of the explosive, such as flyer plate tests. This agreement between theory and experiment is important because it confirms our understanding that shock wave loading is the preponderant source of initiation energy during short duration impacts.

(2) FIGS. 6 and 7 provide the quantative basis for the functioning of this invention. The curve for each cover plate thickness indicates that higher impact velocities are required for initiating that higher impact velocities are required for initiating reactions as the bullet radius is decreased. Note, also, the cross-hatched zones delineating the velocity regime where bullets and fragments represent hazards. These zones extend up to approximately 10,000–12,000 feet per second. Therefore, if contact radii are selected small enough so that more than 12,000 feet per second is required for explosive reaction, the munition will be safe from impacts by bullets and fragments. In designing impact shields for munitions containing COMP B, the contact radius of the protuberances should be less than approximately 3 mm, according to FIG. 6. For PBX-9404, the contact radius should be less than approximately 2 mm, according to FIG. 7. Since contact radii less than 2 mm can be designed and built without practical difficulty, theory and experimental data indicate that this invention is practical.

There is a further requirement in the design of the shield's pointed protuberance that strike the munition when a bullet or fragment impacts the shield, that the shield's point material must be harder than the munition's casing. If a protuberance's point is not hard enough it will be flattened and thus its radius will be increased. This does occur in practice when ordinary bullets impact on munitions. Ordinary bullets produce explosive reactions at velocities much lower than would be required if they did not deform. For this reason, in order for this invention to function effectively, the protuberance points must be hard. An added advantage is that the protuberance will penetrate through the munition's casing, thus providing vents that will prevent hydrodynamic pressure buildups in the explosive as the casings cross-section is deformed and loses its circular shape.

What is claimed is:

1. A munition comprising:
an explosive;
a hard munitions casing surrounding said explosive;
a shield surrounding said munitions casing, said shield further comprising:
a shell; and
a plurality of hardened interior protuberances rigidly mounted on said shell, said interior protuberances being harder than said casing.

2. The munition of claim 1 further comprising a plurality of hardened exterior protuberances integrally located on said shell, said exterior protuberances being harder than said casing.

3. The munition of claim 2 wherein said exterior and interior protuberances are pointed.

4. The munition of claim 3 wherein said exterior protuberances deflect said outside body toward said interior protuberances.

5. The munition of claim 1 wherein said internal protuberances penetrate through said casing when said outside body impacts said munition thereby creating vents that prevent hydrodynamic pressure buildup as said shield strikes said casing and begins to crush said munition.

6. The munition of claim 2 wherein said interior and exterior protuberances are in the shape of right circular cones.

7. The munition of claim 2 wherein said interior and exterior protuberances are in the shape of regular pyramids.

8. The munition of claim 2 wherein said interior and exterior protuberances are in the shape of wedges.

9. An explosion preventing impact shield for protecting a munition, said munition having a hard outer casing and an inner explosive comprising:
a shell; and
a plurality of protuberances rigidly mounted on said shell having contact radii with the casing small enough so that initiation of the munition is prevented when the shield is impacted by a projectile travelling with a velocity, said protuberances being harder than said casing.

10. The shield of claim 9 wherein said protuberances are pointed.

11. The shield of claim 10 wherein said protuberances penetrate through said casing when said outside body impacts said munition thereby creating vents that prevent hydrodynamic pressure buildup on said munition.

12. The shield of claim 10 wherein said pointed protuberances limit shock wave loading on said explosive when said outside body impacts said munition by introducing rarefaction waves in said explosive thereby preventing said explosive from exceeding threshold energy.

13. The shield of claim 10 wherein said protuberances have contact radii of less than about two millimeters.

14. The shield of claim 10 wherein said protuberances have contact radii of less than about three millimeters.

* * * * *